United States Patent [19]

Green

[11] Patent Number: 4,770,413

[45] Date of Patent: Sep. 13, 1988

[54] BREATHING EXERCISE DEVICE

[75] Inventor: Michael J. Green, Clay, N.Y.

[73] Assignee: MBA Healthcare Products, Inc., Fayetteville, N.Y.

[21] Appl. No.: 42,746

[22] Filed: Apr. 27, 1987

[51] Int. Cl.[4] ..... A63B 23/00; A61B 5/08

[52] U.S. Cl. ..... 272/99; 137/269.5

[58] Field of Search ..... 272/99, 130; 128/725, 128/726, 727, 25 R, 205.24, 207.16; 251/285, 284, 290; 137/269.5; 73/239

[56] References Cited

U.S. PATENT DOCUMENTS

| | | | |
|---|---|---|---|
| D. 280,765 | 9/1985 | Alvino | D24/62 |
| 631,036 | 8/1899 | Crump | 137/269.5 |
| 793,577 | 6/1905 | Frank | 137/269.5 |
| 1,821,992 | 9/1931 | Stevens | 137/269.5 |
| 3,314,600 | 4/1963 | Hadley | 417/566 |
| 3,474,818 | 8/1969 | Hartman | 137/269.5 |
| 3,565,099 | 2/1971 | Huber | 137/296.5 |
| 3,635,214 | 1/1972 | Rand et al. | 272/99 X |
| 3,863,914 | 2/1975 | O'Connor | 272/57 F |
| 4,025,070 | 5/1977 | McGill et al. | 128/727 X |
| 4,078,580 | 3/1978 | Rudle | 137/625.66 |
| 4,221,381 | 9/1980 | Ericson | 272/99 |
| 4,259,951 | 4/1981 | Chernack et al. | 128/200.19 |
| 4,291,704 | 9/1981 | Petty et al. | 128/728 |
| 4,444,202 | 4/1984 | Rubin et al. | 128/725 |
| 4,531,137 | 8/1985 | Sonne | 272/99 |
| 4,538,620 | 9/1985 | Nowacki et al. | 128/725 |

FOREIGN PATENT DOCUMENTS

| | | | |
|---|---|---|---|
| 804907 | 1/1969 | Canada | 272/99 |
| 1003850 | 3/1983 | U.S.S.R. | 272/99 |

*Primary Examiner*—Richard J. Apley
*Assistant Examiner*—Howard Flaxman
*Attorney, Agent, or Firm*—Wall and Roehrig

[57] ABSTRACT

A breathing exercise device is formed of a tubular body with a mouthpiece at its proximal end, a resistor sleeve coaxial with the body tube and having a number of resistance openings which align with a body tube opening, and a selective one way flap valve assembly disposed at the distal end of the body tube. The flap valve assembly can be rotated 180 degrees to change the mode of the breathing exercise device from inhalation to exhalation thereapy, or vice versa.

14 Claims, 4 Drawing Sheets

BREATHING EXERCISE DEVICE

BACKGROUND OF THE INVENTION

This invention relates to breathing exercise devices or pulmonary exercise training devices of the type which impart a controlled stress to a subject's breathing muscles.

A number of spirometers or similar exercise devices have been proposed, both for the treatment of patients having emphysema, chronic bronchitis, or similar respiratory disorders, and also for athletes or other well persons who desire to strengthen their breathing and thus improve oxygen uptake and minimize carbon dioxide retention.

These devices conventionally are one-way training devices only, that is, the device can be used for inhalation therapy only or for exhalation therapy only. Separate breathing exercise devices are required if the subject requires both inhalation and exhalation therapy or training.

In devices for inhalation or inspiration therapy or training, the mouthpiece of the device is placed in the patient's or subject's mouth, and inhalation takes place through a resistance aperture or restricted opening on the device. Exhalation takes place through a one-way valve which imparts a comparatively low resistance to the exhaled air exhausted through it.

Exhalation or expiration therapy takes place in a similar device, in which these functions are reversed. That is, exhalation takes place through the resistance aperture, while inhalation takes place through a low resistance one-way valve.

A conventional device for conducting inhalation or inspirational breathing exercise therapy is described in U.S. Pat. No. 4,533,137, and a device for exhalation or expiration therapy is described in U.S. Pat. No. 3,863,914. Another conventional breathing exercise device is described in U.S. Pat. No. 4,444,202. An inspirational muscle training device is shown in Design Pat. No. Des. 280,765. Each of these devices is for inspiration or expiration use only, and cannot be used both as an inspiration and expiration exercise or therapy device. Furthermore, these devices tend to be cumbersome, with projecting or protruding parts, which limit the patient's or subject's ability to carry the device in a pocket and use it when convenient.

OBJECTS IN SUMMARY OF THE INVENTION

Accordingly, it is an object of this invention to provide a breathing exercise device which is compact and rugged, and avoids the drawbacks of the devices of the prior art.

It is another object of this invention to provide a breathing exercise device which can be used alternately in an inspiration therapy mode and an expiration therapy mode.

It is still another object of this invention to provide such a breathing exercise device whose mode can be changed from inspiration therapy to expiration therapy or vise versa, without requiring interchanging or removal of any of its parts.

It is still another object of this invention to provide a one way flap valve or check valve suitable for use in such breathing exercise devices, and which permits the selection of unidirectional air passage from one direction to the other, simply by rotating a portion of the housing.

According to an aspect of this invention, a breathing exercise device is formed of a tubular body with a mouthpiece at its proximal end, an opening in the tubular body, and a resistance sleeve coaxially disposed thereon with a number of resistance openings that can be aligned with a resistance opening on the tubular body. At the distal end of the tubular body is a selective unidirectional flap valve which can be rotated to select the direction of blocking of air flow through the distal end, and likewise the direction through which it admits air flow, so that the breathing exercise device can be used for either inspirational exercise therapy or expiration exercise therapy by selecting the direction of flow of the flap valve means. Favorably, the unidirectional flap means includes a flexible disc or diaphragm, a rotatable end cap pivotally mounted at the distal end of the tubular body, and mounting the disc or diaphram. The end cap includes first stop means disposed to the distal side of the disc and second stop means disposed to the proximal side of the disc. The first and second stop means are favorably arranged as generally semicircular members that are disposed on an interior wall of the end cap and diametrically opposite one another. The tubular body can include a cooperating substantially semicircular baffle at the distal end, which leaves a generally semicircular opening. The end cap is then rotatable into first and second positions to align the first and second stop means, respectively, with this semicircular opening, and so select inspriation or expiration modes.

The above and many other objects, features, and advantages of this invention will be more fully understood from the ensuing detailed description of the preferred embodiment, which should be read in connection with the accompanying drawing.

DETAILED DESCRIPTION OF THE PREFERRED EMBODIMENT

Figure 1:
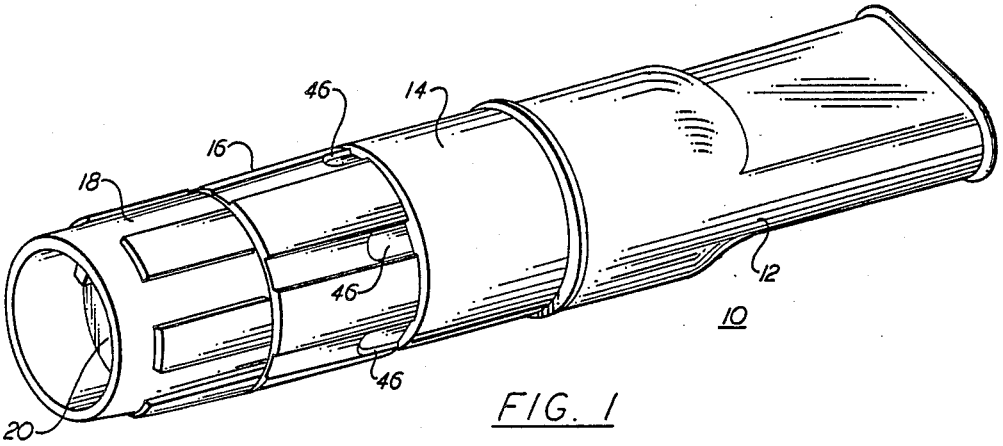
FIG. 1 is a prospective assembly view of a breathing exercise device according to a preferred embodiment of this invention.

With reference to the Drawing, and initially to FIG. 1 thereof, a breathing exercise device 10 of this invention comprises, in the direction from its proximal to its distal ends, a mouthpiece 12 formed of a biocompatible flexible resin material, a body tube 14, a resistor sleeve 16, which is rotatable to select the amount of resistance to breathing, and an end cap 18, which contains a rubber disc diaphragm 20, and which is rotatable on the body tube 14 to select the direction of blocking of air flow through the distal end of the body tube 14.

The end cap 18, the disc 20 and distal end of the body tube 14 together form a selective unidirectional valve or check valve for admitting fluid flow, in this instance air, in a selected direction (i.e., inhalation or exhalation) and for blocking its flow in the other direction (i.e., exhalation or inhalation).

Figure 2:
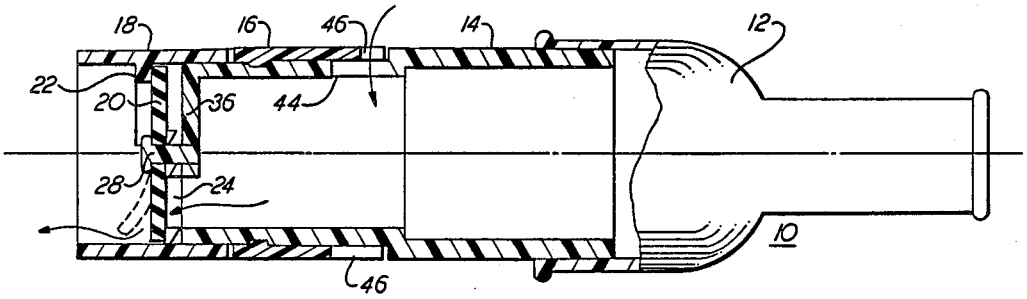
FIG. 2 is an elevation, partly in section, of the breathing exercise device of FIG. 1, here set in its mode for inspirational breathing stressing.
Figure 3:
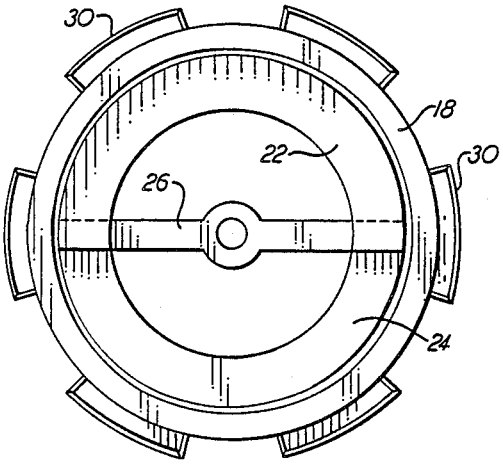
FIGS. 3, 4, and 5 are a distal end view, a sectional elevation, and a proximal end view, respectively, of the end cap or sleeve of the breathing exercise device of FIG. 1.
Figure 4:
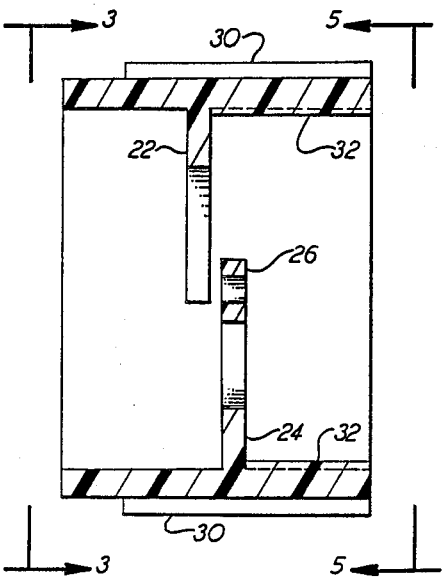
Figure 5:
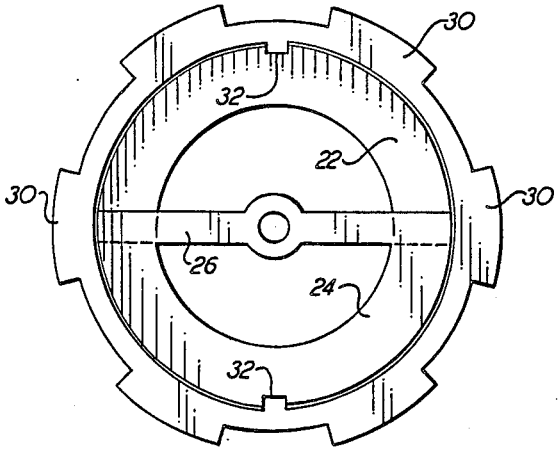
Figure 2A:
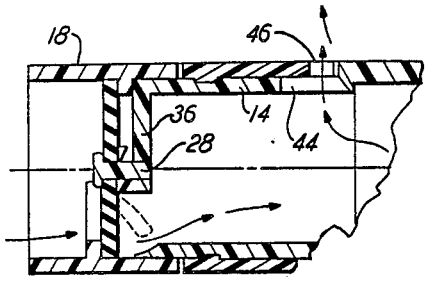
FIG. 2A is a partial section elevation of the device, similar to that of FIG. 2, but set in its mode for expiration therapy.

Details of the end cap 18 are shown in FIGS. 2–5. The end cap 18 is generally cylindrical, and has a first semicircular stop member 22 formed on its inner wall and to the distal side of the diaphragm 20 (left in FIGS. 2 and 4) and a second semicircular stop member formed on the inner wall proximally of the diaphragm 20 (right in FIGS. 2 and 4) and diametrically opposite the first stop member 22. A mounting bar 26 is disposed at the plane of the second stop member 24, and connects its ends, as shown in FIG. 3. A pin 28, formed integrally with the body tube 14 and along its axis, fits through center apertures of the diaphragm 20 and the mounting bar 26 of the end cap 18, and holds the latter pivotally for rotation about the body tube 14. This pin 28 is staked as shown in FIGS. 2 and 2A.

To facilitate gripping with the fingers, ribs or crenellations 30 are formed on the outer surface of the end cap 18. Upper and lower teeth 32 are formed on the inner wall of the end cap 18 and to the proximal side thereof (FIG. 5) and these cooperate with a detente 34 in the body tube 14 (FIG. 8).

Figure 8:
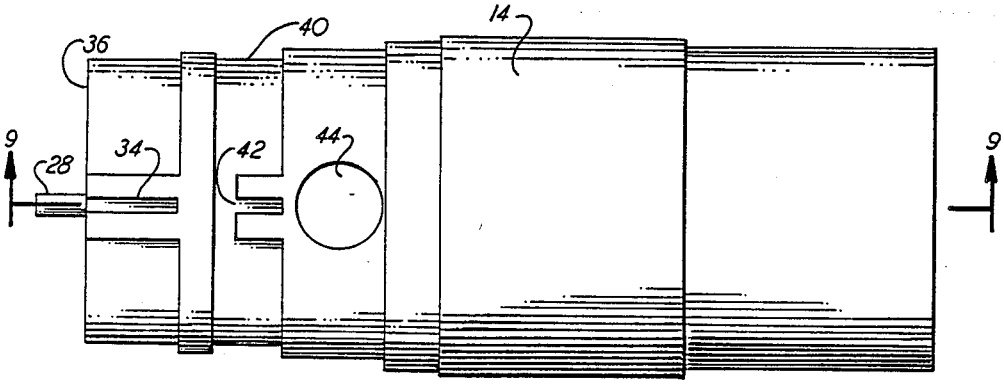
FIGS. 8, 9, and 10 are a top plan view, a side sectional elevation, and an end view, respectively, of the main body tube portion of the breathing exercise device of FIG. 1.
Figure 9:
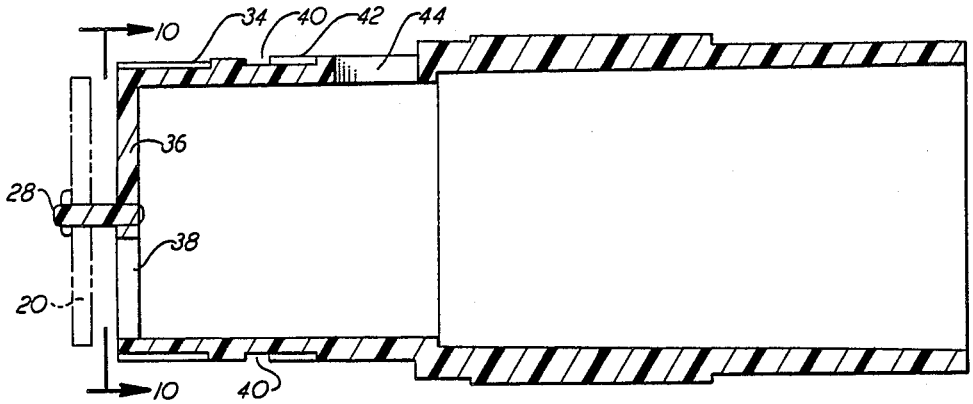
Figure 10:
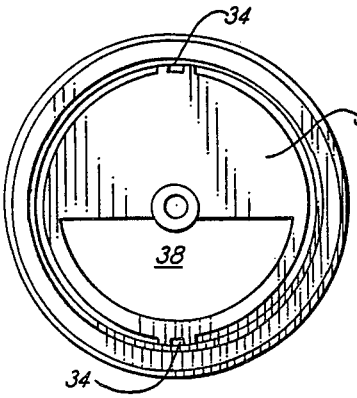
Figure 11:
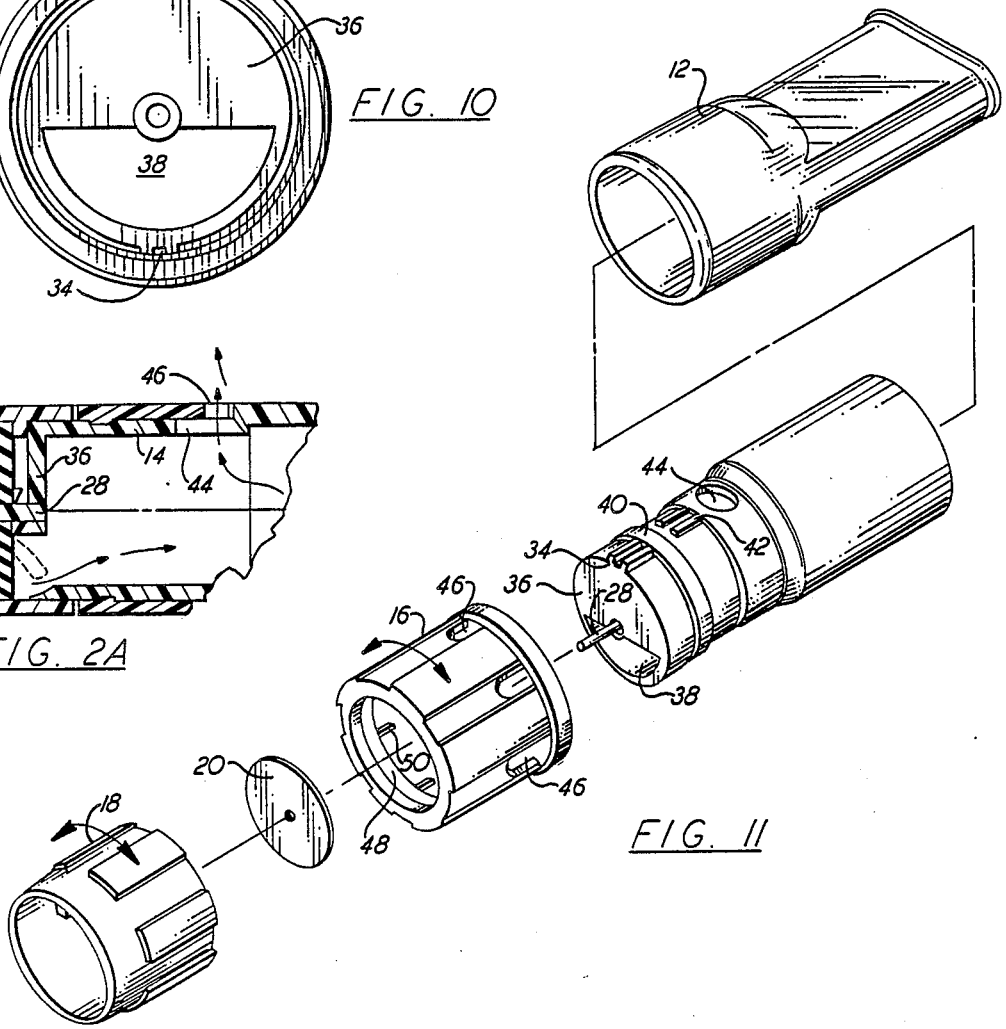
FIG. 11 is an exploded assembly view of the breathing exercise device of FIG. 1.

The body tube 14, as shown in FIGS. 8, 9, and 10, has a generally semicircular end wall or baffle 36 at its distal end, and this leaves a semicircular opening 38. An annular recess 40 is formed on the circumferencial wall of the body tube 14 proximally of the detentes 34, and this recess 40 includes upper and lower detentes 42. A body tube resistance opening 44 passes through this circumferential wall of the body tube 14, as shown in FIGS. 8, 9, 11.

Figure 7:
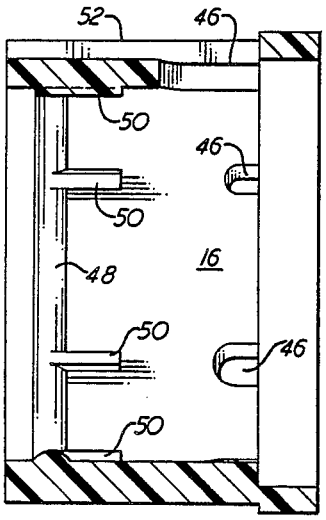
FIGS. 6 & 7 are an end view and a sectional view, respectively, of the resistor sleeve of the breathing exercise device of FIG. 1.
Figure 6:
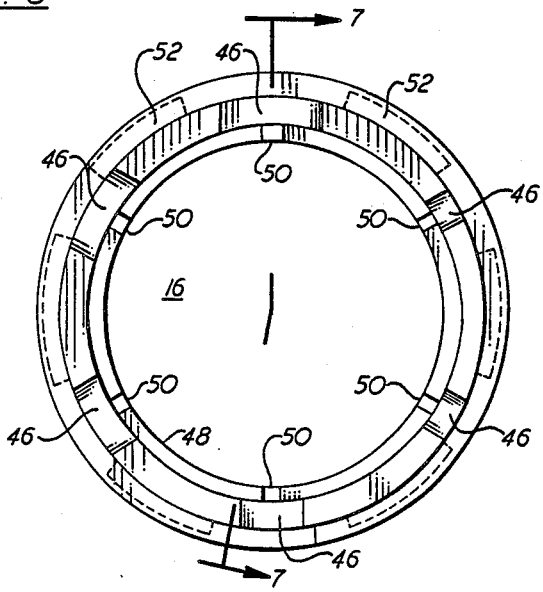

The resistor sleeve 16, as shown if FIGS. 6 and 7, has a plurality of resistance openings 46 disposed at spaced intervals about its circumference, each being of a different size, and adapted to align with the body tube opening 44. The sleeve 16 has an annular rib 48 formed on its inner wall, and this rib 48 fits into the annular recess 40 of the body tube 14. The sleeve 16 also has a number of longitudinal ribs 50, each of which corresponds to the position of a respective resistance opening 46, which fit into the detentes 42 when the openings 46 are aligned with the body tube opening 44.

As is also shown in FIGS. 1, 6, and 7, ribs or crenellations 52 are formed on the outer surface of the sleeve 16 to facilitate gripping thereof with the fingers so that the same can be easily rotated to select the amount of breathing resistance. The resistance openings 46 occur in the valleys between these ribs 52.

The use of the device for inhalation therapy can be easily described with reference to FIG. 2. With the mouthpiece 12 placed in the subject's mouth, the subject inhales, and this draws the lower half of the disc or diaphram 20 against the stop member 24. Breathing air is thus admitted only through the resistance opening 46 that is aligned with the body tube opening 42, as shown by the solid-line arrows. However, when the subject exhales, the disc or diaphram 20 moves freely outward, as shown in those lines, and the exhalation air follows a low resistance path, as shown with the dash-line arrows.

To use this device for exhalation therapy, the end cap is rotated 180 degrees to the position as illustrated in FIG. 2A. Here, when the subject inhales, the air enters the distal end of the device and deflects the diaphragm inward to the position shown in ghost lines. Inhalation air is subjected to quite low resistance, and flowing as shown by solid-line arrows. When the subject exhales, the disc 20 presses against the stop member 22, and the exhalation air exhausts only through the resistor opening 46 as illustrated by dash-line arrows.

Although the resistor sleeve 16 is here shown to have six resistance openings 46, a different number, such as nine or twelve openings, could be employed instead. The parts of this breathing exercise device 10 can be formed of any suitable material, such as a convenient synthetic resin material, the choice depending on convenience in molding.

Figure 12:
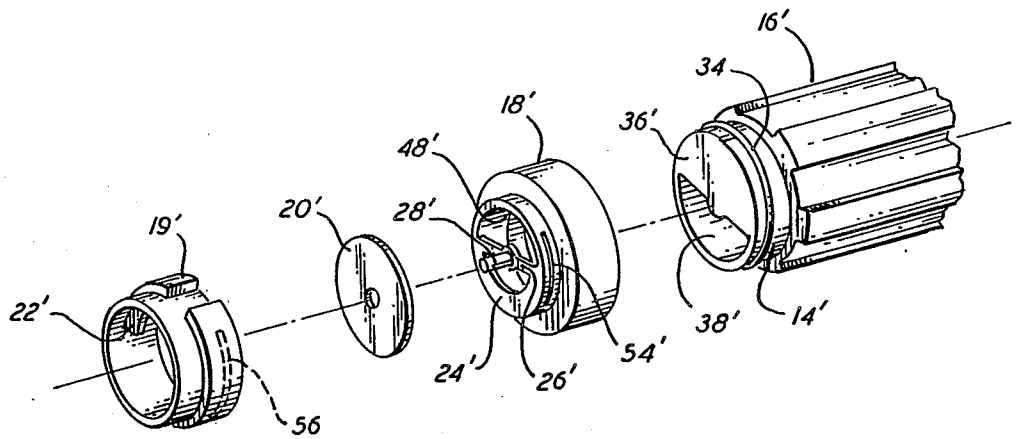
FIG. 12 is an exploded partial assembly view for illustrating a variation of the device of FIG. 1.

A variation of the above device is illustrated in FIG. 12, in which like parts are identified with the same reference numbers to which a prime (') has been added. Here the resistor sleeve 16' is placed over the body tube 14', and the distal end of the latter has a semi-circular baffle 36' which leaves a semicircular opening 38'. The device has a two-part end cap formed of a first portion 18' and a mating second portion 19'. The portion 18' carries the bar 26' and semicircular stop member 24', with the pin 28' being formed on the bar 26'. The disc 20' fits onto the pin 28' and the second portion 19' snaps in place in the first portion 18'. The first portion 18' has a recess 54' and the second portion 19' has mating rib 56' to hold the portions 18', 19' together.

The semicircular stop portion 22' is carried on the second half 19'.

The first half 18' is rotatably held onto the body portion 14' by means of a rib 48' which mates with an annular recess 34' on the wall of the body tube 14'.

While the reversible valve mechanism is employed here in a breathing exercise device, it should be recognized that the valving mechanism, to wit, the end cap 18, body tube 14, and disc or diaphragm 20, could be adapted for controlling fluids other than air, or could be used in devices other than breathing exercising devices.

It should also be mentioned that the exercise device assembly 10 of this embodiment is carried out in a device with slender, streamlined appearance, with all of its parts being generally tubular and disposed coaxially on the body. This provides a compact and convenient design, as well as being inexpensive to manufacture.

While a single preferred embodiment has been described in detail hereinabove, it should be apparent that many modifications and variations would present themselves to those with skill in the art without departing from the scope and spirt of this invention, as defined in the appended claims.

What is claimed is:

1. Breathing exercise device comprising a tubular body having a longitudinal tube axis, a mouthpiece at a proximal end thereof, a resistance opening in the tubular body, and a distal end, resistance means on the tubular body for imparting a selected resistance to air flow through said resistance opening, and selective unidirectional flap valve means disposed on the distal end of the tubular body for selectively blocking air flow in one direction through said distal end and admitting air flow in the other direction, including means rotatable about the longitudinal tube axis for selecting the directions of blocking and admitting, so that said breathing exercise device can be used for either inspirational exercise therapy or expirational exercise therapy, by selecting the direction of flow of said flap valve means.

2. The breathing exercise device of claim 1 in which said resistance means includes a tubular resistance sleeve over said tubular body and having a plurality of apertures therein of various sizes, said resistance sleeve being rotatable about the longitudinal tube axis to align a desired one of said apertures with said resistance opening.

3. The breathing exercise device of claim 1 in which said selective unidirectional flap means includes means rotatable about the longitudinal tube axis between first and second positions for blocking air flow in the distal direction but admitting air flow in the proximal direction, and for blocking air flow in the proximal direction but admitting air flow in the distal direction, respectively.

4. Breathing exercise device comprising a tubular body having a mouthpiece at a proximal end thereof, a resistance opening in the tubular body, and a distal end, resistance means on the tubular body for imparting a selected resistance to air flow through said resistance opening, and selective unidirectional flap means disposed on the distal end of the tubular body for selectively blocking air flow in one direction through said distal end and admitting air flow in the other direction, including means for selecting the directions of blocking and admitting, so that said breathing exercise device can be used for either inspirational exercise therapy or expirational exercise therapy, by selecting the direction of flow of said flap valve means, in which said unidirectional flap valve means includes a flexible disc, a rotatable end cap pivotally mounted at the distal end of said tubular body and mounting said disc thereon, the end cap including first stop means to the distal side of said disc and second stop means to the proximal side of said disc for selectively blocking flexing of said disc in the distal and proximal directions, respectively.

5. The breathing exercise device of claim 4 in which said first and second stop means include generally semicircular members disposed on an interior wall of said end cap and diametrically opposite one another.

6. The breathing exercise device of claim 5 in which said distal end of the body tube has a substantially semicircular baffle and a complementary semicircular opening, said end cap being rotatable into first and second positions to align said first and second stop means, respectively, with said opening.

7. A selective unidirectional check valve for admitting fluid flow in a selected one of proximal and distal directions and blocking flow in the other of said directions, comprising a tubular body having a longitudinal tube axis, and flap valve means rotatable about the longitudinal tube axis between first and second positions respectively for blocking fluid flow in the distal direction but admitting fluid flow in the proximal direction, and for blocking fluid flow in the proximal direction but admitting fluid flow in the distal direction.

8. A selective unidirectional check valve for admitting fluid flow in a selected one of said proximal and distal directions and blocking flow in the other of said directions, comprising a body tube having a distal end and flap valve means rotatable between first and second positions respectively for blocking fluid flow in the distal direction but admitting fluid flow in the proximal direction, and for blocking fluid flow in the proximal direction but admitting fluid flow in the distal direction; in which said flap valve means includes a flexible disc, a rotatable sleeve pivotally mounted at the distal end of said body tube and mounting said disc thereon, the sleeve including first stop means to the distal side of said disc and second stop means to the proximal side of said disc for blocking flexing of said disc in the distal and proximal directions, respectively.

9. The unidirectional check valve of claim 8 in which said first and second stop means include generally semicircular members disposed on an interior wall of said sleeve and diametrically opposite one another.

10. The unidirectional check valve of claim 9 in which said distal end of the body tube has a substantially semicircular baffle and a complementary semicircular opening, and said sleeve is rotatable into first and second positions to align said first and second stop means, respectively, with said opening.

11. The breathing exercise device of claim 3 in which said means rotatable about the longitudinal tube axis includes a generally cylindrical member coaxial with the tubular body.

12. The breathing exercise device of claim 11 in which said cylindrical member has crenellations formed on an outer surface thereof to facilitate gripping with the fingers.

13. The breathing exercise device of claim 11 in which said cylindrical member includes detente means which engage cooperating means on the tubular body to define said first and second positions.

14. The breathing exercise device of claim 2 wherein said tubular resistance sleeve includes a generally cylindrical member having a said apertures disposed at evenly spaced intervals therein, and detente means which engage cooperating means on said tubular body to define the positions of the respective apertures in alignment with said resistance opening.

* * * * *

UNITED STATES PATENT AND TRADEMARK OFFICE

CERTIFICATE OF CORRECTION

PATENT NO. : 4,770,413

DATED : Sept. 13, 1988

INVENTOR(S) : Michael J. Green

It is certified that error appears in the above-identified patent and that said Letters Patent is hereby corrected as shown below:

Claim 4, Column 5, line 26, after "flap" insert --valve--.

Signed and Sealed this

Eleventh Day of April, 1989

*Attest:*

DONALD J. QUIGG

*Attesting Officer*

*Commissioner of Patents and Trademarks*